United States Patent [19]

Vandergriff

[11] 4,143,470

[45] Mar. 13, 1979

[54] EVEN HEAT PARALLEL FLOW TOWER DRYER

[76] Inventor: Arvel L. Vandergriff, 1701 Heffner St., Corcoran, Calif. 93212

[21] Appl. No.: 826,945

[22] Filed: Aug. 16, 1977

[51] Int. Cl.[2] ..... F26B 3/10

[52] U.S. Cl. ..... 34/10; 34/25; 34/57 R; 19/0.27; 19/66 CC

[58] Field of Search ..... 34/10, 25, 33, 54, 57 R, 34/79, 169, 171, 223, 224, 225, 232, 233; 19/0.27, 66 CC

[56] References Cited

U.S. PATENT DOCUMENTS

| | | | |
|---|---|---|---|
| 2,189,099 | 2/1940 | Bennett | 19/0.27 |
| 2,214,680 | 9/1940 | Sims | 19/0.27 |
| 2,332,413 | 10/1943 | Teague | 19/0.27 |
| 2,968,874 | 1/1961 | Fishburn | 34/57 R |
| 3,277,581 | 10/1966 | Towery et al. | 19/0.27 |
| 4,031,593 | 6/1977 | Vandergriff | 34/57 R |

*Primary Examiner*—John J. Camby
*Assistant Examiner*—Larry I. Schwartz
*Attorney, Agent, or Firm*—Mason, Fenwick & Lawrence

[57] ABSTRACT

A seed cotton drying system of the parallel flow tower type, having vertically spaced horizontal shelves alternately extending from opposite sides of the tower to locations near but spaced from the opposite side to define a continuing zig zag cotton flow path from the top of the bottom through which the cotton travels impelled by the conveying heated air. The spacing of the shelves increases from the top to the bottom, and fresh hot air is introduced between the shelves where there is an increase in shelf spacing.

13 Claims, 5 Drawing Figures

EVEN HEAT PARALLEL FLOW TOWER DRYER

BACKGROUND AND OBJECTS OF THE INVENTION

The present invention relates in general to conditioning of seed cotton for ginning, and specifically for drying of high moisture seed cotton, and more particularly to seed cotton drying systems involving a tower dryer wherein seed cotton descends along a continuous restricted zigzag path defined by shelf-like partitions in a casing forming the tower dryer, with the seed cotton being impelled along the zigzag path by a high velocity stream of heated air.

Heretofore, the harvesting of high moisture seed cotton has been recognized as a quality problem as early as the 1930's and much work has been carried on in developing methods of drying the seed cotton prior to ginning the cotton, including work carried on by the U.S. Department of Agriculture Ginning Laboratory at Stonesville, Miss. Work by the U.S.D.A. Ginning Laboratory resulted in what has become known as the parallel flow tower dryer, which for many years has been the most prevalent type of seed cotton drying employed at the pre-ginning stage in cotton ginning installation.

Those early efforts were directed at lowering the moisture content of the seed cotton enough to allow the gin to produce a smooth sample. High moisture seed cotton resulted in rough preparation of the lint. The "preparation" of the lint was a very important quality factor, along with "Grade" and "Staple". More recently, the wide use of lint cleaners which involve a combing action, which are customarily used in gin plants in association with gin stands or between the gin stands and the battery condenser, result in smooth preparation due to the combing action of the lint cleaners under almost all moisture conditions and the "preparation" factor is no longer as significant a factor in quality as it once was.

Prior to World War II, a number of gins were equipped with dryers to improve the preparation, but in those cases, except for the arid areas of Texas and Oklahoma, very little seed cotton cleaning was used in addition to the drying. The labor shortage of the post-World War II period made the careful hand harvesting of seed cotton impractical, and mechanical harvesting of cotton developed at a very rapid rate. This usually resulted in the adding of moisture to improve the efficiency of the seed cotton harvester, resulting in a significant increase in the need for drying at the gin plant prior to the ginning of the seed cotton. Also, the mechanical harvesting method resulted in much more foreign matter being brought to the gin. It was found that drying the lint to a low moisture content improved the efficiency of the seed cotton cleaning achieved at the gin, and gins across the country rapidly installed two states of drying and began to use more and more heat energy to produce better grades of cotton notwithstanding the mass of leaf trash and stems in the high moisture seed cotton resulting from mechanical harvesting methods. In fact, use of three states of drying in gins to improve seed cotton cleaning is not uncommon today.

The parallel flow tower dryer has become the most commonly and successfully used of the drying apparatus by the ginning industry. The parallel flow tower dryer method involves the use of direct fired heaters usually rated at from 3,000 B.T.U. up using natural gas, liquid propane gas or oil, for heating the conveying air designed to impel the seed cotton through the tower dryer. This air for drying and impelling the seed cotton passes through the heater from a suitable blower, picks up the seed cotton to be dried from a rotary airlock under a feeder, and conveys it to the top of the parallel flow tower dryer. The tower dryer involves a plurality of parallel vertically spaced shelves which alternately extend from one end wall of a vertically elongated casing to a location near but spaced from the opposite end wall to define a zigzag or labyrinth path descending from the top to the bottom of the tower. The heated air conveys the cotton along the shelves of the tower, dropping it from one shelf to the next and tumbling the seed cotton as it changes directions at the end of the shelf. As the seed cotton reaches the bottom of the tower dryer, the conveying air carries it through a duct to an air-separating unit where the drying air is separated from the cotton and discharged to the atmosphere.

An important factor in the efficiency of the tower dryer system is the velocity of the air over the shelves, referred to commonly as "shelf velocity". Obviously, the shelf velocity has to be high enough to convey the seed cotton across the shelf and, unfortunately, this required velocity varies with the density of the cotton which is a function of moisture content. The best efficiency is obtained at the lowest shelf velocity which will convey the cotton along the shelves. In the early stages of development of the tower dryer, it was found that about 40 cu. ft. of air per pound of material was optimum. At this ratio, shelf velocities as low as 900 feet per minute were very successful. This resulted in low static pressure losses across the tower and only moderate air temperatures were required.

Of course, such tower dryer systems were expected to handle only damp cotton, varying in lint moisture from about 8% to 10%. As opposed to this condition, modern high capacity gin plants are set up to handle maximum moisture contents of from 15% to 20%, although only a small percentage of the cotton being dried has such a high moisture content. This requires shelf velocities in the range of about 3,000 feet per minute to successfully convey the cotton over the shelves at ratios of 25 to 30 cu. ft. of air per pound of material. At these velocities, the cotton is exposed to the drying air for a very short period. To compensate for this short exposure, higher temperatures are used, resulting in excessive consumption of fuel.

An object of the present invention is the provision of a tower dryer system which will reduce energy and fuel consumption and achieve higher efficiency drying of the seed cotton, thereby achieving significant economies in the initial cost of seed cotton drying systems because of reduced horsepower requirements for air propelling equipment and achieving economies in operation due to greater conservation of heat energy.

As a means of attaining this object, I have devised a parallel flow tower dryer which provides for a high shelf velocity over approximately the upper one-half or upper one-third of the shelves, which will lower the density of the seed cotton material being handled sufficiently to permit a reduced velocity over the next approximately one-half or one-third of the shelves. The reduced velocity in this lower one-half, or middle approximately one-third of the shelves is accomplished by a wider shelf spacing. In the case of three different shelf-spacings, the lower approximately one-third of the shelves has a still wider shelf spacing for a still lower velocity, since the seed cotton continues to become less dense as the air absorbs the moisture.

Further, I have attained greater heat conservation and heating efficiency in the system by increasing the shelf spacing at intervals of the downward travel sufficiently to accommodate a fresh supply of heated air between the shelves where there is an increase in spacing. One innate weakness of the present tower dryer structure is the rapid cooling of the drying air as it absorbs moisture. When high moisture cotton is introduced into the drying and conveying air, it is rapidly cooled by evaporation, as well as radiation losses. In order to maintain an effective drying temperature at the separation point, the initial temperature must be very high, especially if the moisture content of the cotton is high.

By providing several stages of increased shelf spacing and applying fresh heated air between the shelves where there is an increase in shelf spacing, an even air temperature can be maintained throughout the drying system. The source of heated air to be applied between the shelves can be the same heating source as that used for heating the conveying air, or a separate source of heat may be provided. By keeping the temperature of the conveying air up to a point which will provide a good moisture transfer rate throughout the system, the efficiency is greatly improved, and an efficient moisture transfer can be accomplished by such an even heat dryer construction without having excessively high temperatures at the inlet of the drying system.

Yet another object of the present invention is the provision of a novel even heat parallel flow tower dryer structure for drying seed cotton, wherein horizontal shelves extend in alternation from opposite sides of the tower to locations near but spaced from the opposite side to define a continuous zig-zag cotton flow path from the top to the bottom through which the cotton travels impelled by conveying heated air, and wherein a relatively higher shelf velocity is provided for in the upper half of the dryer, while a selectively reduced shelf velocity is provided in the lower half by increasing the spacing of the shelves, or wherein three or more different shelf spacings are provided with the uppermost shelf spacing being smaller and the succeeding lower sections having a larger spacing than the preceding section, thereby selectively reducing shelf velocity in the successive sections of different shelf spacing, and wherein fresh hot air is supplied at each increase in shelf spacing to maintain a more uniform rate of moisture absorption through the height of the tower dryer.

Other objects, advantages and capabilities of the present invention will become apparent from the following detailed description, taken in conjunction with the accompanying drawings illustrating a preferred embodiment of the invention.

DETAILED DESCRIPTION OF A PREFERRED EMBODIMENT

Figure 1:
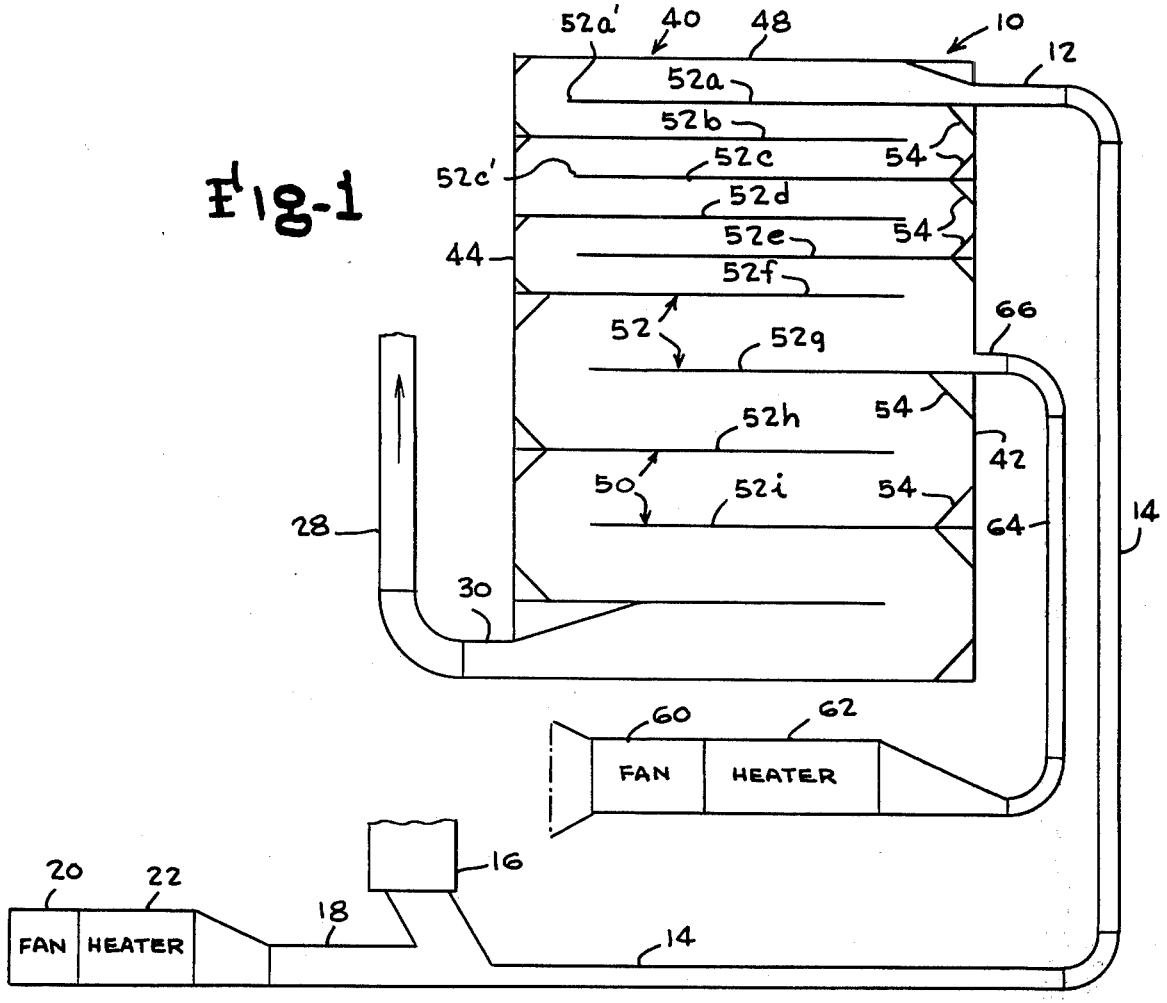
FIG. 1 is a somewhat diagrammatic elevation view of a portion of a seed cotton processing line including the even heat parallel flow tower dryer of the present invention, wherein the heated cotton conveying air carrying the cotton to the tower dryer inlet and the fresh hot air supplied to lower zones of the dryer are derived from separate sources, parts of the dryer casing being broken away to illustrate its interior.
Figure 2:
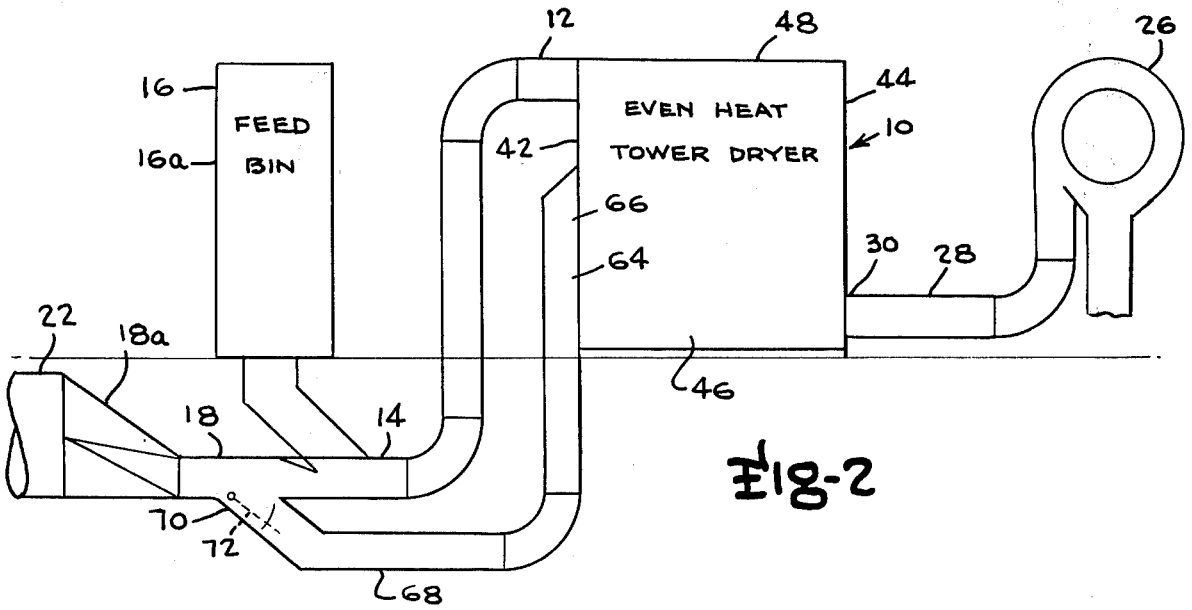
FIG. 2 is a diagrammatic elevation view of the even heat parallel flow tower dryer and principal components associated therewith in a typical installation.
Figure 3:
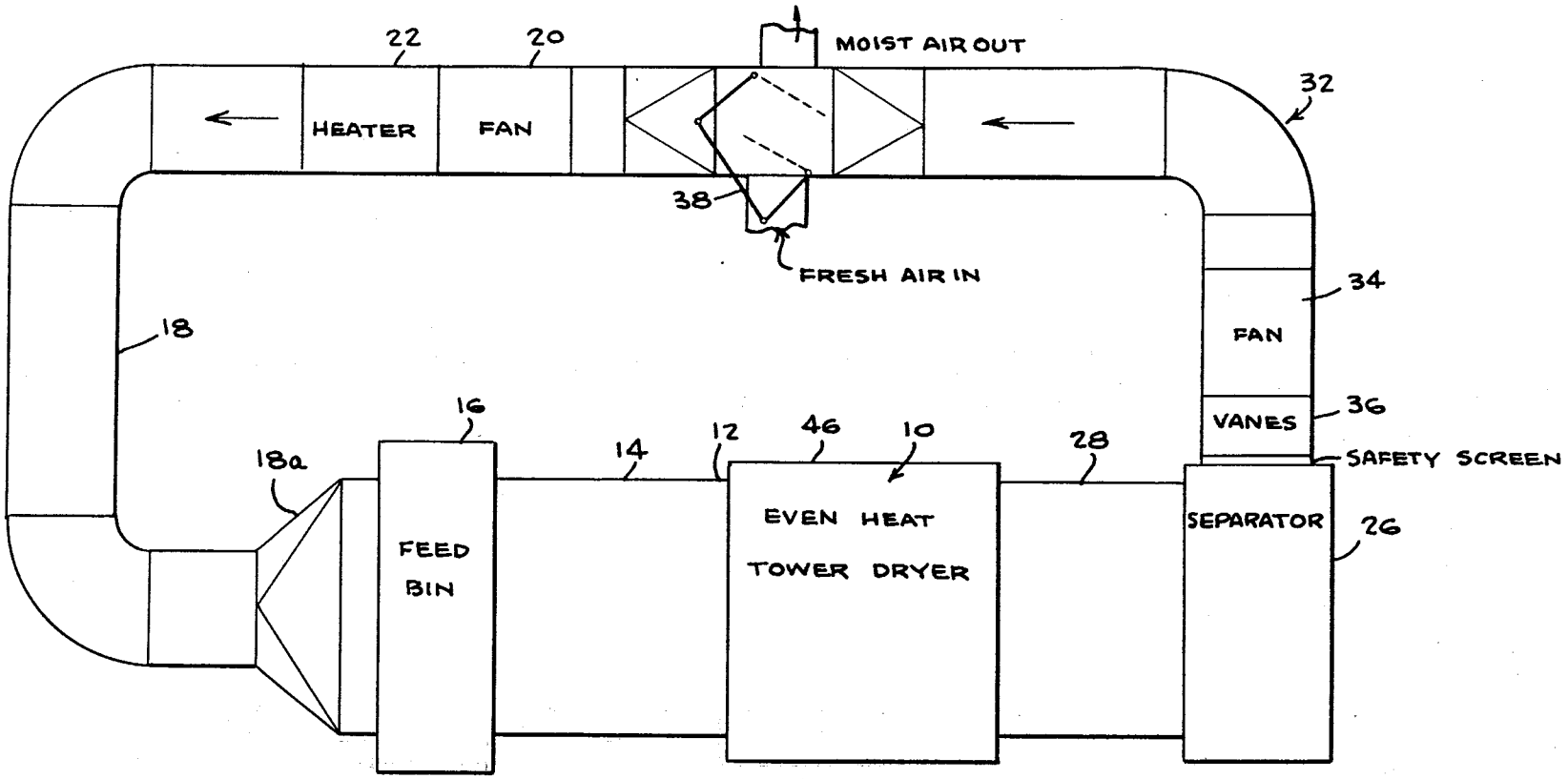
FIG. 3 is a diagrammatic top plan view of the installation of FIG. 2.

Referring to the drawings, wherein like reference characters designate corresponding parts throughout the several figures, there is illustrated in FIGS. 1, 2 and 3, in somewhat diagrammatic form, the principal components of a portion of a seed cotton processing line immediately associated with and including an even heat parallel flow tower dryer, indicated generally by the reference character 10, constructed in accordance with the present invention, FIG. 2 further illustrating in a flow chart type of presentation the basic components associated with the dryer 10 for handling the seed cotton and the conveying and drying air to be supplied to the tower. Referring to FIGS. 1 and 2, the even heat parallel flow tower dryer 10 of the present invention is interposed in a seed cotton processing line in a location similar to the conventional parallel flow tower dryer previously discussed, to receive at the cotton inlet 12 of the tower dryer 10 seed cotton being pneumatically conveyed along with conveying-drying air through the pneumatic conveying inlet duct 14 extending, for example, from the bottom discharge outlet of a conventional cotton seed control bin 16. The feed control bin 16 may, for example, be of the type having a vertically elongated large surge bin portion **16*a* to receive cotton from a condenser type cotton-air separator at the top of the unit, and provided with variable feed rollers at the bottom of the surge bin 16*a* delivering the cotton through an air-seal vacuum dropper section into a pneumatic conveying air stream of heated air. Conventionally, the pneumatic conveying air stream of heated air is supplied to the upstream end of the conveyor duct portion 14 through an air supply duct section 18 from a push fan 20 and associated heater unit 22. The feed control bin 16 may receive pneumatically conveyed cotton at the upper separator portion thereof from any conventional upstream cotton handling equipment, or the cotton-air separator may be dispensed with and the upper end of the feed control bin 16** simply receive the seed cotton directly from the discharge of an inclined impact cleaner of conventional construction, for example of the inclined revolving screen type which removes sticks, leaves and hull particles, motes, and other trash from the seed cotton delivered to the impact cleaner by an unloader separator or other conventional equipment.

The processing line portions of the cotton processing system downstream of the even flow parallel flow tower dryer 10 of the present invention may include, in a typical installation, a conventional revolving screen separator 26 connected by a pneumatic cotton conveyor duct 28 to the cotton and conveying-heating air outlet 30 of the tower dryer 10. The separator would preferably act in a conventional manner to separate the seed cotton received from the tower dryer from the conveying air and discharge it through an associated vacuum dropper section to further cotton processing equipment, while the conveying-heating air which has lost a portion of its heat energy may be simply discharged to the exterior of the gin plant, or as indicated in FIGS. 2 and 3 it may be recirculated through a return pneumatic system, indicated generally by the reference character 32, which may comprise a return air duct connected between the separator 26 and a moist air pull fan 34 with associated vanes and safety screen 36, for withdrawing the air from the separator 26 and propelling it through a controlled fresh air intake 38 where selected proportions of fresh air may be drawn into the return system 32 and added to the air being recycled, while related portions of the damp air returning from the dryer outlet 30 are discharged from the system. The proportioned fresh air and return air is then conducted by the return duct system 32 to the push fan 20 and conveyed through the heater 22 for delivery to the upstream end of the air supply duct section 18.

The even heat parallel flow tower dryer 10 of the present invention, in the illustrated embodiment, comprises a vertically elongated casing 40 of generally rectangular box-like configuration, which is relatively high and has a relatively square horizontal cross-sectional profile having a width which may correspond generally to the width of the ducting system 14 supplying the seed cotton to the inlet 12 of the tower dryer 10. The casing 40 may comprise vertical front and rear sheet metal panels 42, 44, and parallel vertical side panels 46, together with a top panel 48 and transverse sheet metal shelf panels generally indicated at 50 in FIGS. 1 and 2, extending transversely between the side panels 46 and dividing the interior of the dryer into a plurality of vertically spaced and horizontally extending shelves 52 extending alternately from the front panel 42 and rear panel 44 of the dryer. As shown generally in FIG. 1, the shelves 52*a*, 52*c*, 52*e*, 52*g*, and 52*i* each extend from the front wall panel 42 or right hand side as viewed in FIG. 1 and terminate short of the left hand or rear panel 44, while the alternate shelves 52*b*, 52*d*, 52*f*, 52*h*, and 52*j* extend from the rear wall 44 of the casing and terminate short of the right hand or front panel 42. The spacing between the free ends of the shelves, for example the ends 52*a*', 52*c*', and the adjacent front or rear wall of the casing is in each instance approximately equal to the vertical spacing between the confronting surfaces of the associated shelf and its vertically adjacent shelf, so that there is thus formed a continuous restricted zig-zag or labyrinth passage from top to bottom of the casing between the cotton inlet 12 and the cotton outlet 30 with a reversal of direction at the free end or delivery end of each shelf. The shelves may simply be formed of flat horizontal sheet metal panels, and the root or supported end of each shelf has, in the illustrated example, inclined ramp-like guide plates 54 associated therewith to facilitate smooth reversal of direction of the cotton at the 180° turns in the labyrinth passage about the free ends of the shelves.

The vertical spacing of the shelves 52 is arranged, in the illustrated example, in such a way as to provide a decreasing velocity in the tower dryer as the cotton travels downwardly through the labyrinth passage, to allow the cotton to travel slower as its density decreases and thus provide a longer and more thorough exposure of the fibers to the heated air coursing through the dryer. In the example illustrated in FIGS. 1 and 2, the variable shelf spacing is such that the shelves 52*a* through 52*f* in the upper region of the tower dryer are spaced more closely together than the shelves 52*g* through 52*i* in the lower approximately one-half of the tower dryer. For example, in one exemplary embodiment, the tower dryer may be about 21 feet tall, the spacing between the top panel 48 and the uppermost shelf 52*a* and between each of the successive pairs of shelves 52*a*–52*f* may be about 15 inches, and the spacing between the confronting surfaces of the shelves 52*f*–52*i* and between the shelf 52*i* and the bottom of the tower may be about 18 inches.

Figure 4:
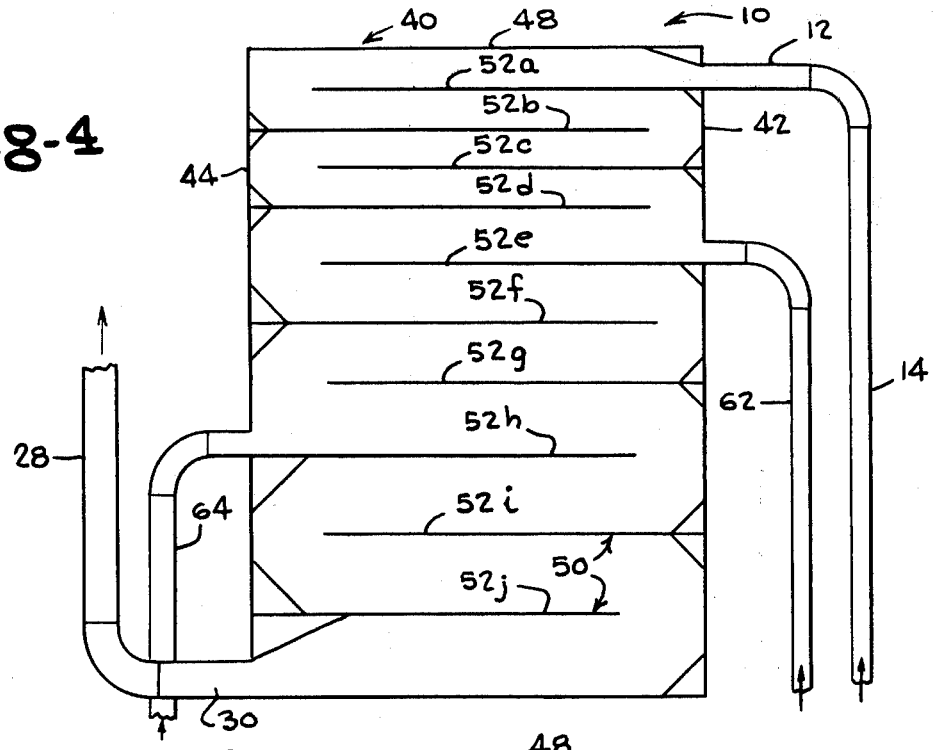
FIG. 4 is a vertical longitudinal section view through an even flow dryer provided with three stages of different shelf spacings and fresh hot air supplies for each stage.

Alternatively, an arrangement similar to that shown in FIG. 4 may be provided wherein the vertical extent of the tower dryer is subdivided into three sections of different shelf spacing, with the shelves in the upper one-third of the tower spaced about 15 inches apart, the shelves in the middle zone or central section of the dryer spaced about 18 inches apart, and the shelves in the lower one-third of the tower spaced about 21 inches apart.

Figure 5:
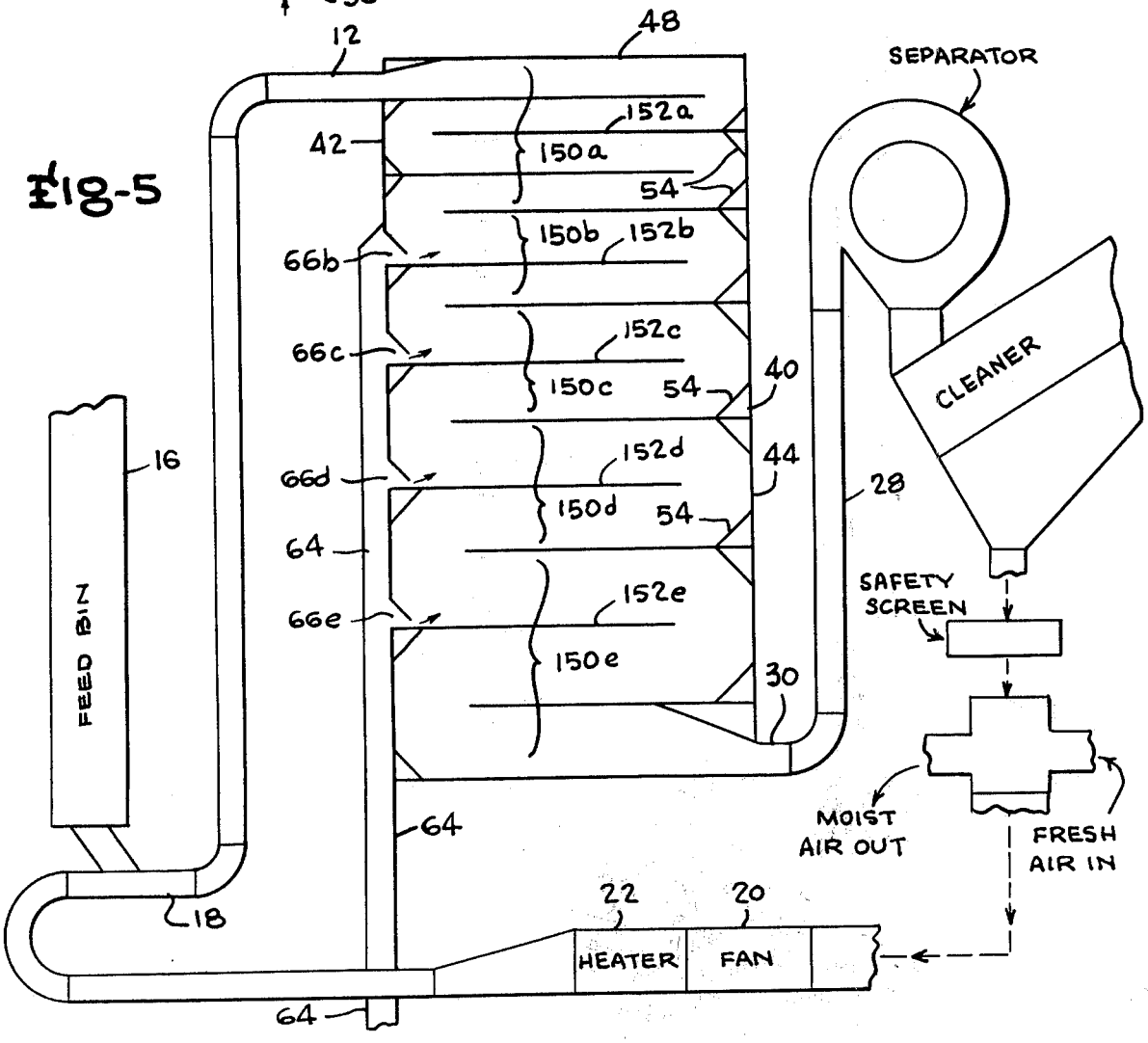
FIG. 5 is a vertical section view through another even heat tower dryer having five different stages for sections of different shelf spacings progressively increasing in shelf spacing from top to botton, with fresh hot air supplies for each section, embodying the present invention.

It will be apparent that other variations in spacing of the shelves to provide for progressive or periodic increase in the cross-sectional area of the zig-zag cotton passage from the top to the bottom of the dryer may be selected by the designer to provide the desired rate of decreasing velocity within the tower, and that the shelf spacing may increase a predetermined amount progressing from each shelf to the next from the top to the bottom of the dryer, rather than having the plural shelves in each of a plurality of vertical subdivisions of the tower dimensioned to have one selected spacing with the shelf spacing in each of the subsections increasing in a downwardly progressing manner from the top to the bottom of the tower. FIG. 5 illustrates a variation in which the tower dryer is subdivided into five subsections, with the first four shelves spaced vertically one selected distance apart, for example 12 inches, the next two shelves spaced a larger distance apart from the shelf immediately above, for example 15 inches, and each of the next three sets of two shelves also spaced vertically a greater distance apart from the immediately overlying shelf, for example 18 inches, 21 inches and 24 inches respectively.

In order to maximize drying efficiency of the dryer for high capacity implants and provide for improved drying in the lower zones of the tower dryer where the cotton conveying-heating air delivering the cotton to the inlet at the top of the dryer will have lost much of its heat energy, I provide fresh heating air introduced into the zig-zag cotton passage at the top of each section or subdivision of increased shelf spacing throughout the height of the dryer. In the embodiment illustrated in FIG. 1, this fresh heated air is derived from a source separate from the fan 20 and heater 22 supplying the cotton conveying-heating air to the supply duct 18, and to this end includes an additional fan 60 and heater 62 associated therewith, which supplies fresh hot air through the duct 64 to the fresh hot air inlet 66 in the front wall 42 of the tower immediately above the shelf 52*g*, which is the first shelf spaced below its adjacent superior shelf a distance greater than the spacing between the successive shelves 52*a*–52*f*.

Alternatively, as illustrated in FIG. 2, the heated air supplied through the duct 64 and fresh hot air inlet 66 may be derived from the same fan and heater as the cotton conveying-heating air delivering the cotton to the inlet 12 of the dryer. To this end, a branch heated air supply duct 68 may be joined by a Y section 70 to the upstream end portion of heated air supply duct 18 immediately downstream from the fan 20 and heater 22, and may be provided with an adjustable damper 72 or similar device to select the proportion of heated air discharged from the fan 20 and heater 22 into the branch duct 68 for delivery to the duct 64 and fresh hot air inlet 66 to supply the supplemental heating air to the upper end of the lower wider shelf spacing zone.

Alternatively, to achieve even greater economy, particularly in regard to fuel consumption for the heating system and power for the air moving system, the fan 20 and heater 22 can be connected as illustrated in FIGS. 2 and 3 through the return duct system 32 and fresh air intake valve unit 38 with the air withdrawn from the separator 26, and this reprocessed mixture of fresh air and return air supplied through the transition 18*a* to the air supply duct 18 immediately upstream of the Y branch section 70 to supply both the cotton conveying and heating air through the duct 14 to the upper tower inlet 12 and also supply the supplemental heating air to the branch duct 68 and duct 64 for discharge through the inlet 66 into the upper end of the wider shelf spacing section.

As illustrated in FIG. 5, the vertical supply duct 64 for the supplemental heating air for the upper ends of each of the progressively wider shelf spacing sections may discharge air through a plurality of vertically spaced fresh hot air inlets corresponding in number to the number of different shelf spacing sections below the uppermost section. In the example shown in FIG. 5, fresh air inlet nozzles 66*b*, 66*c*, 66*d*, and 66*e* communicate with the vertical supplemental heated air supply duct 64 and supply additional heating air to the zig-zag cotton passage at the root of the uppermost shelves 152*b*, 152*c*, 152*d* and 152*e* in the second, third, fourth and fifth zones 150*b*, 150*c*, 150*d* and 150*e* of successively wider shelf spacing below the first, narrowest shelf spacing section 150*a*.

By this construction, a unique system of seed cotton control is provided by which seed cotton may be received at the gin at maximum moisture content of up to about 20% and be efficiently reduced in moisture content in a single dryer stage and a single system to the optimum level for trash removal. Cotton which needs little or no drying, as well as that of high moisture content, may be protected from dangerously low moisture levels by a control system such as that illustrated and described in my earlier U.S. Pat. No. 4,031,593 granted June 28, 1977 wherein the moisture is continuously monitored by a pilot stream moisture monitoring branch and regulating the proportion of fresh air and return air returned to the fan 20 and heater 22 by the controller 38. The delivery of supplemental heated air or fresh hot air through the supplemental air supply nozzle 66 at the top of each successive wider shelf spacing section or subdivision maintains a more uniform temperature from the beginning to the end of the zig-zag drying passage and a temperature which will allow a good moisture transfer rate throughout the drying system. The recirculation system achieves significant economies in consumption of fuel by the dryer-heater system, since this avoids the necessity of always having to heat fresh supplies of ambient air to provide the necessary heated air for the system. Following initial seed cotton cleaning by conventional cleaning machinery, the seed cotton may then be exposed to controlled humidity air where the moisture content is brought back to about 7% to 8% prior to being exposed to the high stress action of the saws and ribs in the gin in the course of separating the lint from the seed. This reduces the fiber breakage to a minimum at this stage of the process which has been a major source of fiber damage.

What is claimed is:

1. Seed cotton dryer apparatus of the parallel flow tower type for conditioning seed cotton for ginning comprising, a vertically elongated drying tower casing having spaced apart vertical lateral walls and front and rear sides and having an inlet adjacent the top for connection to an air duct through which seed cotton is conveyed to receive cotton-conveying heated drying air and cotton conveyed by the drying air and having an air and cotton outlet adjacent the bottom, means for conveying heated drying air and seed cotton to the air duct, means for heating the drying air, a plurality of vertically spaced horizontal metallic shelves fixed in the casing transversely spanning the casing between said lateral walls, said shelves from the uppermost to the lowermost commencing alternately from opposite sides of the casing and each terminating short of the side opposite its commencement thereby defining a continuous restricted zig-zag flow path from the upper end to the lower end of the casing communicating respectively with said inlet and said outlet, the heated drying air and cotton conveyed thereby being admitted to the upper end of said flow path at said inlet to be circulated through said flow path for evaporating moisture from the cotton in the dryer while the drying air impels the cotton along the flow path, the successive shelves in an upper portion of the dryer apparatus forming a first predetermined vertical subsection having a smaller vertical spacing between successive shelves than the vertical spacing between successive shelves in the remaining portion therebelow forming a second vertical subdivision to provide a higher heated drying air velocity of said drying air over the shelves in said first subdivision than over the shelves in said second subdivision along said flow path, and additional heated air supply duct means connected to the means for heating drying air and to an intermediate portion of the casing for continuously adding further heated drying air without cotton to said flow path at the top of said second vertical subdivision during operation of the dryer apparatus.

2. Seed cotton dryer apparatus as defined in claim 1, wherein the additional heated air supply duct means includes an air inlet opening located immediately above the uppermost shelf in said second vertical subdivision for directing the additional heated drying air along such uppermost shelf of the second subdivision to course along the flow path through that subdivision with the cotton-conveying heated drying air and cotton introduced through said inlet.

3. Seed cotton dryer apparatus as defined in claim 1, wherein a plurality of said shelves in the upper approximately one-third of said dryer apparatus are spaced a first relatively smaller distance apart vertically and form said first vertical subdivision, the shelves in the vertical mid-region of the dryer apparatus are spaced a second larger distance apart vertically, and the shelves in the lower third of the dryer apparatus are spaced apart vertically a relatively greater distance than the shelves in either of the other regions to provide a higher shelf velocity for the heating air over the groups of shelves in the first region and progressively lower shelf velocities in the mid-region and the lower region of the dryer apparatus, the mid-region and the lower region forming said second vertical subdivision.

4. Seed cotton dryer apparatus as defined in claim 1, wherein the shelves of the tower dryer are arranged in a plurality of successive zones spaced vertically along the height of the casing with a plurality of shelves in each zone, the plural shelves of each respective zone being spaced the same vertical distance apart and the vertical spacing for each successive zone descending from the top to the bottom of the casing being increased relative to the shelf spacing of the zone immediately thereabove, to provide progressively lower shelf velocities for the heating air over the shelves in each successive zone descending from the top to the bottom of the casing, and said additional heated air supply duct means including an air inlet opening located in the upper portion of each of said zones below the uppermost zone to continuously add further heated drying air without cotton to the flow path at the top of each successive zone below the uppermost zone.

5. Seed cotton dryer apparatus as defined in claim 1, including separator means for separating the heated air and cotton issuing from said outlet from each other, and recirculating means for recirculating a variable portion of the heating air back to said inlet to be recycled through said means for heating the drying air and through said flow path.

6. Seed cotton dryer apparatus as defined in claim 1, including separator means for separating the heated air and cotton issuing from said outlet from each other, recirculating means for recirculating a variable portion of the heating air back to said inlet to be recycled through said means for heating the drying air and through said flow path, and means for supplying a portion of the heated air from said means for heating the drying air supplied to said additional heated air supply duct means to provide the further heated air added to the flow path.

7. Seed cotton dryer apparatus as defined in claim 4, including separator means for separating the heated air and cotton issuing from said outlet from each other, and recirculating means for recirculating a variable portion of the heating air back to said inlet to be recycled through said means for heating the drying air and through said flow path.

8. Seed cotton dryer apparatus as defined in claim 4, including separator means for separating the heated air and cotton issuing from said outlet from each other, recirculating means for recirculating a variable portion of the heating air back to said inlet to be recycled through said means for heating the drying air and through said flow path, and means for supplying a portion of the heated air from said means for heating the drying air supplied to said additional heated air supply duct means to provide the further heated air added to the flow path.

9. Seed cotton dryer apparatus of the parallel flow tower type for conditioning seed cotton for ginning comprising, a vertically elongated drying tower casing having spaced apart vertical lateral walls and front and rear sides and having an inlet adjacent the top for connection to an air duct through which seed cotton is conveyed to receive cotton-conveying heated drying air and cotton conveyed by the drying air and having an air and cotton outlet adjacent the bottom, means for conveying heated drying air and seed cotton to the air duct, means for heating the drying air, a plurality of vertically spaced horizontal metallic shelves fixed in the casing transversely spanning the casing between said lateral walls, said shelves from the uppermost to the lowermost commencing alternately from opposite sides of the casing and each terminating short of the side opposite its commencement thereby defining a continuous restricted zig-zag flow path from the upper end to the lower end of the casing communicating respectively with said inlet and said outlet, the heated drying air and cotton conveyed thereby being admitted to the upper end of said flow path at said inlet to be circulated through said flow path for evaporating moisture from the cotton in the dryer while the drying air impels the cotton along the flow path, said dryer apparatus being subdivided into a plurality of vertical subdivisions each having a plurality of said shelves therein, the successive shelves in the uppermost subdivision having a smaller vertical spacing between successive shelves than the shelves of the subdivisions therebelow, and the shelves of each respective subdivision in descending order from the top to the bottom of the dryer being each spaced apart vertically a relatively greater distance than the spacing of the shelves in the subdivision immediately thereabove to provide an increase in the vertical spacing between shelves at each successive subdivision in descending order from the top to the bottom of the casing to provide a progressively lower shelf velocity of said drying air in each successive lower subdivision, and additional heated air supply duct means connected to the means for heating drying air and to intermediate portions of the casing having air inlet openings at the upper portion of each successsive subdivision below the uppermost subdivision for continuously adding further heated drying air without cotton to the flow path at the top of each of the vertical subdivisions below the uppermost subdivision.

10. Seed cotton dryer apparatus as defined in claim 9, including separator means for separating the heated air and cotton issuing from said outlet from each other, and recirculating means for recirculating a variable portion of the heating air back to said inlet to be recycled through said means for heating the drying air and through said flow path.

11. Seed cotton dryer apparatus as defined in claim 9, including separator means for separating the heated air and issuing from said outlet from each other, recirculating means for recirculating a variable portion of the heated air back to said inlet to be recycled through said means for heating the drying air and through said flow path, and means for supplying a portion of the heated air from said means for heating the drying air supplied to said additional heated air supply duct means to provide the further heated air added to the flow path.

12. The method of conditioning seed cotton for ginning which comprises impelling the cotton along shelf surfaces defining a restricted zig-zag path in a tower dryer from a higher to a lower level by means of a high velocity stream of heated air flowing along said path, reducing the velocity of the impelling heated air in successive predetermined stages along said zig-zag path in the dryer by successively increasing the shelf spacing therein, supplying additional heated air without cotton continuously to the uppermost portion of each of the successive predetermined stages of increasing shelf spacing, and discharging the cotton and impelling air from the dryer and separating the cotton from the impelling air.

13. The method of conditioning seed cotton defined in claim 12, including recycling at least some of the separated impelling heated air through a heating stage and returning the same to the higher level of the tower dryer with additional heated air to supply the high velocity stream of heated air for impelling the cotton through the dryer.

* * * * *